United States Patent [19]

Tanaka et al.

[11] Patent Number: 4,927,130

[45] Date of Patent: May 22, 1990

[54] AUTOMATIC SHEET FEEDER

[75] Inventors: Hironori Tanaka, Yamatokoriyama; Matahira Kotani; Masafumi Matsumoto, both of Nara, all of Japan

[73] Assignee: Sharp Kabushiki Kaisha, Osaka, Japan

[21] Appl. No.: 241,372

[22] Filed: Sep. 6, 1988

[30] Foreign Application Priority Data

Sep. 7, 1987 [JP] Japan ..... 62-224790

[51] Int. Cl.[5] ..... B65H 5/06

[52] U.S. Cl. ..... 271/10; 271/114

[58] Field of Search ..... 271/114, 116, 4, 10

[56] References Cited

U.S. PATENT DOCUMENTS

| | | | |
|---|---|---|---|
| 3,761,079 | 9/1973 | Azure | 271/116 |
| 4,032,135 | 6/1977 | Ruenzi . | |
| 4,113,244 | 9/1978 | Ruenzi . | |
| 4,212,456 | 7/1980 | Ruenzi . | |
| 4,522,385 | 6/1985 | Steffansson | 271/116 X |
| 4,674,735 | 6/1987 | DuBois | 271/116 X |
| 4,715,596 | 12/1987 | Cantrell | 271/116 |

FOREIGN PATENT DOCUMENTS

| | | |
|---|---|---|
| 2307738 | 11/1976 | France . |
| 592011 | 10/1977 | Switzerland . |

*Primary Examiner*—Richard A. Schacher

[57] ABSTRACT

An automatic sheet feeder comprises a feed roller which feeds sheets stacked in a pile one by one to a sheet conveying path, a conveyor roller provided on the sheet conveying path to convey the sheet delivered to the sheet conveying path by the feed roller to an image reading unit. The sheet conveying speed of the conveyor roller is higher than the sheet feeding speed of the feed roller. A feed roller gear is mounted on a feed roller shaft fixedly supporting the feed roller thereon and is interlocked with the feed roller shaft by a one-way clutch mechanism. The clutch mechanism couples the feed roller gear with the feed roller shaft to drive the feed roller for rotation by the feed roller gear until the leading edge of the sheet arrives at the nipping line of the conveyor roller. Thereafter the feed roller shaft is uncoupled from the feed roller gear so that the feed roller is rotated through the sheet by the conveyor roller after the leading edge has arrived at the nipping line of the conveyor roller. The feed roller gear and the feed roller shaft are again coupled in a fixed time after the trailing edge of the sheet has left the feed roller.

5 Claims, 4 Drawing Sheets

AUTOMATIC SHEET FEEDER

BACKGROUND OF THE INVENTION

The present invention relates to an automatic sheet feeder for use in combination with a facsimile equipment, a copying machine, an optical character reader or the like, for automatically feeding documents, recording sheets or the like to reading unit, a recording unit or a reproducing unit.

A general automatic sheet feeder for use, for example, in combination with an optical character reader is shown in FIGS. 4 and 5. A sheet conveying path is formed between a lower guide plate 1, and an upper guide plate 1' disposed substantially in parallel to the lower guide plate 1. A sheet is conveyed along the sheet conveying path in the direction of arrows. A plurality of sheets stacked in a pile on a feed table, not shown, provided at the entrance of the sheet conveying path are fed one by one intermittently by the cooperative sheet feeding operation of an eccentric first feed roller 2 and a feed spring 15 resiliently pressed against the first feed roller 2. A second feed roller 3 and a highly abrasion-resistant separating rubber plate 16 separate the sheets so that the sheets are fed surely one at a time. A contact, optical image sensing head 6 reads the information recorded on the sheet while the sheet is conveyed along the sheet conveying path by a first conveyor roller 4, first pinch roller 4' pressed against the first conveyor roller 4, a second conveyor roller 5, and a second pinch roller 5' pressed against the second conveyor roller 5.

Although the second feed roller 3 and the separating rubber plate 16 are provided to separate the sheets and to feed the sheets one by one, the second feed roller 3 and the separating rubber plate 16 are unable to surely separate the sheets so that multiple sheet feed is prevented, because the sheet conveying speed is inevitably low to enable the optical image sensing unit 6 to read the information recorded on the sheets. Accordingly, to separate two overlapping sheets, the first conveyor roller 4 is rotated at a circumferential speed higher than that of the second feed roller 3 to convey one of the two overlapping sheets pinched between the first conveyor roller 4 and the first pinch roller 4' at a conveying speed, namely, the circumferential speed of the first conveyor roller 4, higher than the feed speed, namely, the circumferential speed of the second feed roller 3. This speed difference causes the sheet pinched between the first conveyor roller 4 and the first pinch roller 4' to slip relative to the other sheet so that the two sheets are separated from each other. However, since the second feed roller 3 is driven through a feed roller gear 10 at a fixed rotating speed, the sheet conveyed by the first conveyor roller 4 at a high conveying speed rubs on the second feed roller 3, which increases the load on the first conveyor roller 4. To eliminate such a disadvantage, the feed roller gear 10 is mounted through a one-way clutch 9 on the shaft 8 of the second feed roller 3 so that the second feed roller 3 is dragged by the sheet being conveyed by the first conveyor roller 4 at the conveying speed higher than the feed speed.

Nevertheless, in this conventional automatic sheet feeder, the second feed roller 3 feeds the second sheet placed on the first sheet immediately after the first sheet has left the second feed roller 3, so that the first and second sheets are fed successively with a small interval. This small interval causes erroneous detection of the trailing edge or the leading edge of the sheet. Such erroneous detection is a significant problem in certain equipment, such as facsimile equipment, which reads and transmits information recorded on individual sheets.

SUMMARY OF THE INVENTION

Accordingly, it is an object of the present invention to provide an automatic sheet feeder having a simple construction, capable of surely and stably separating and conveying sheets one by one, and capable of accurately setting intervals between the successive sheets.

Briefly described, in accordance with the present invention, an automatic sheet feeder comprises a feed roller which separates sheets stacked in a pile and feeds the sheets one by one into a sheet conveying path, and a conveyor roller provided in the sheet conveying path to convey the sheet fed by the feed roller to an image reading unit, and rotated at a circumferential speed higher than that of the feed roller, characterized in that a feed roller gear is mounted through a one-way clutch on the shaft of the feed roller so that torque is transmitted to the feed roller before the conveyor roller starts conveying a sheet and so that the feed roller is dragged for rotation by the sheet after the conveyor roller has started conveying the sheet, and a mechanism is provided to drive the feed roller through the feed roller gear a fixed time after the sheet has left the feed roller.

Thus, the automatic sheet feeder of the present invention stops the feed roller for a fixed time after the trailing edge of the first sheet has left the feed roller and starts driving the feed roller through the feed roller gear to feed the second sheet, and thereby the successive sheets are conveyed at fixed intervals corresponding to the fixed time for which the feed roller is stopped.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereunder and the accompanying drawings which are given by way of illustration only, and thus are not limitative of the present invention and wherein.

DESCRIPTION OF THE PREFERRED EMBODIMENT

Figure 4:
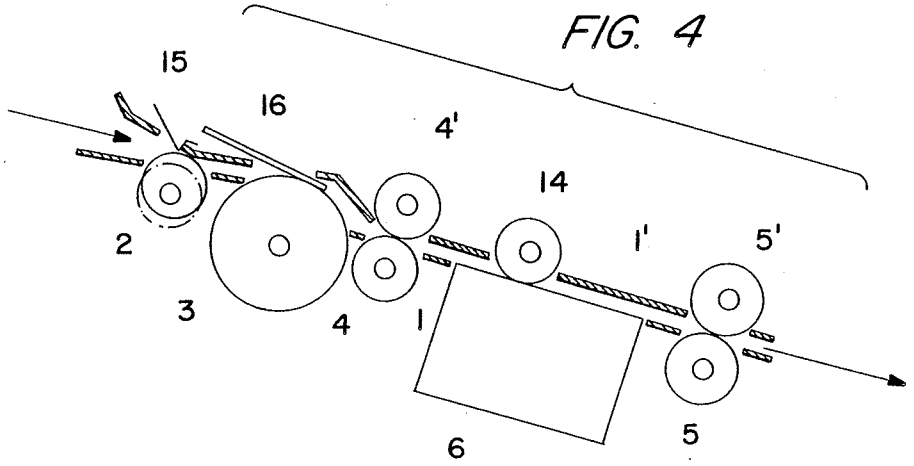
FIG. 4 is a schematic side elevation of a sheet conveying path.
Figure 5:
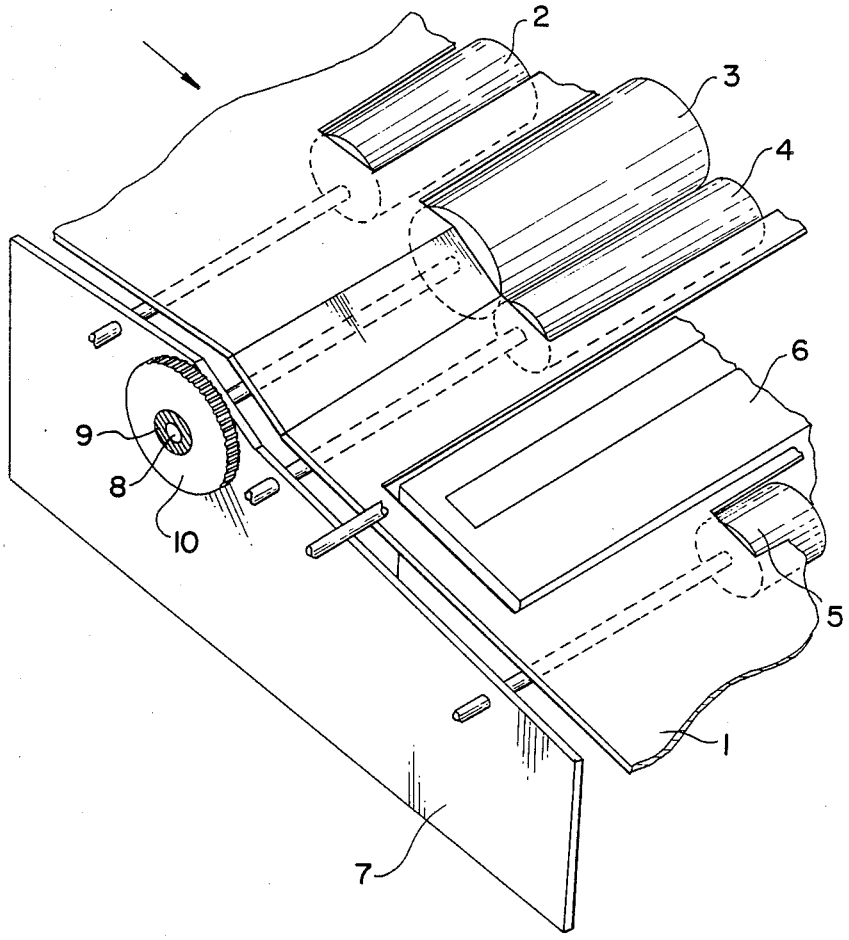
FIG. 5 is a fragmentary perspective view of an essential portion of a conventional automatic sheet feeder.

A preferred embodiment of the present invention will be described hereinafter with reference to FIGS. 1 and 2, in which like or corresponding parts to those previously described with reference to FIGS. 4 and 5 are denoted by the same reference numerals and the description thereof will now be omitted.

Figure 1:
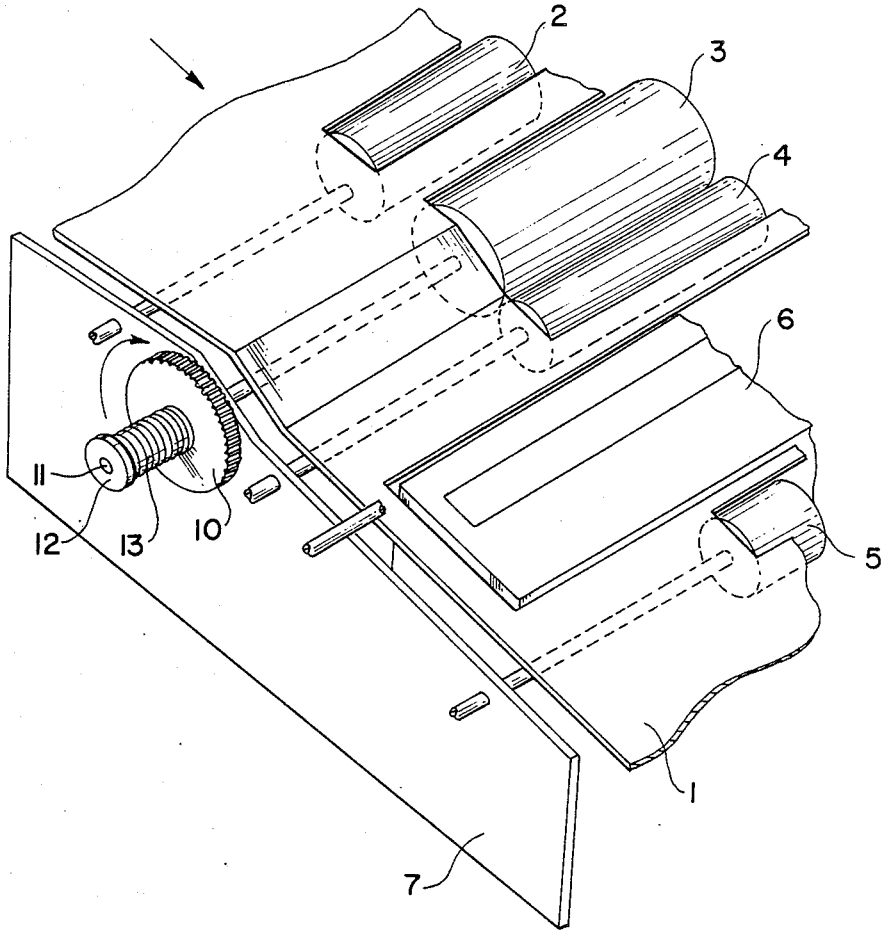
FIG. 1 is a fragmentary perspective view of an essential portion of an automatic sheet feeder in a preferred embodiment according to the present invention.
Figure 2:
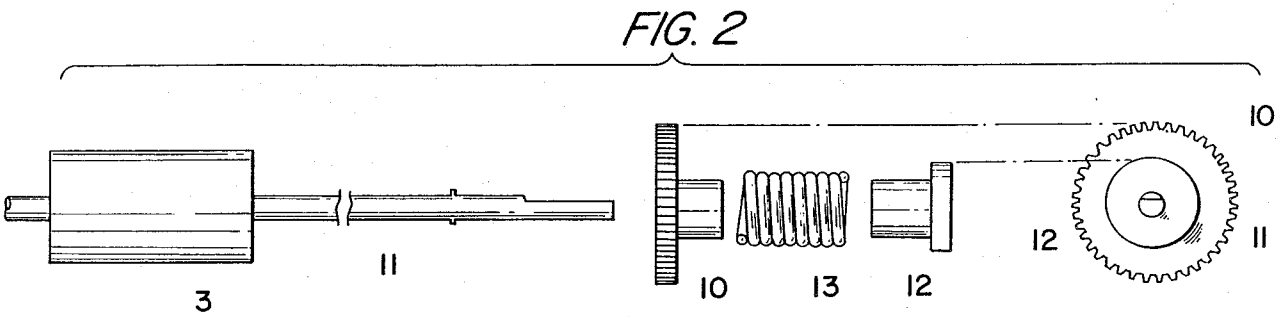
FIG. 2 is an exploded view of a one-way clutch of assistance in explaining the construction of the one-way clutch.
Figure 3A:
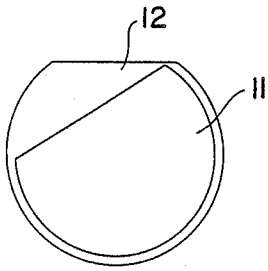
FIGS. 3*a*, 3*b* and 3*c* are views showing the positional relation between a feed roller gear and a feed roller shaft.

Referring to FIG. 1, a principal mechanism of an automatic sheet feeder of the present invention comprises a feed roller gear 10, a feed roller shaft 11, a coupling member 12, and a coil spring 13. Referring to FIG. 2, the feed roller gear 10 is mounted at a fixed position on the feed roller shaft 11 fixed to a feed roller 3, and is positioned at a predetermined position on the feed roller shaft 11 by a stopper provided on the feed roller shaft 11. The coil spring 13 is fitted on the boss of the feed roller gear 10. The coupling member 12 is mounted on the feed roller shaft 11 so that the boss thereof having the same outside diameter as that of the boss of the feed roller gear 10 is fitted in the coil spring 13. The coil spring 13 is coiled and disposed on the bosses of the feed roller gear 10 and the coupling member 12 so that the inside diameter thereof is diminished when the same is twisted in the normal direction, namely, a rotational direction in which the feed roller 3 is rotated to feed a sheet. An E-type snap ring, not shown, is fitted on the feed roller shaft to retain the feed roller gear 10, the coupling member 12 and the coil spring 13 in place on the feed roller shaft 11. A portion of the circumference of the free end of the feed roller shaft 11 where the coupling member 12 is placed is cut in a flat surface to form the free end of the feed roller shaft 11 in a D-shaped cross section as best shown in FIG. 3*a*. The bore of the coupling member 12 is also formed in a D-shaped cross section substantially corresponding to the shape of the free end of the feed roller shaft 11 except that the chordal length of the bore of the coupling member 12 is slightly smaller than that of the free end of the feed roller shaft 11. Accordingly, although not rotatable relative to the feed roller shaft 11, the coupling member 12 is able to turn through a small angle relative to the feed roller shaft 11.

Figure 3B:
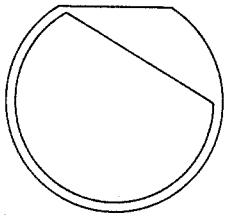
Figure 3C:
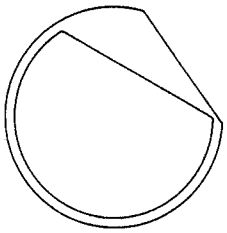

Referring to FIGS. 3*a*, 3*b* and 3*c*, in operation, the feed roller gear 10 is driven for rotation in the direction of an arrow (FIG. 1), namely, the normal direction, by a driving gear, not shown. A torque applied to the feed roller gear 10 is transmitted through the coil spring 13 to the coupling member 12 to turn the coupling member 12 to a position shown in FIG. 3*a*.

Since the feed roller gear 10 is rotated continuously in the normal direction, a torque is applied continuously to the coupling member 12, and the coil spring is twisted so that the inside diameter thereof is diminished to couple the feed roller gear 10 and the coupling member 12 completely for simultaneous rotation. The torque of the feed roller gear 10 is thereby transmitted through the coupling member 12 to the feed roller shaft 11. Consequently, the feed roller 3 is rotated in the normal direction. The feed roller 3 separates a sheet from the following sheets and delivers the sheets to a conveyor roller 4.

When the leading edge of the sheet is nipped between the conveyor roller 4 and a pinch roller 4' pressed against the conveyor roller 4 while the sheet is being fed by the feed roller 3, the sheet starts running at a conveying speed, namely, the circumferential speed of the conveyor roller 4 which is higher than that of the feed roller 3. Hence, the rotating speed of the feed roller 3 exceeds that of the feed roller gear 10. Consequently, the feed roller shaft 11 is turned relative to the coupling member 12 to change the relative angular position of the coupling member 12 relative to the feed roller shaft from a relative angular position shown in FIG. 3*a* to a relative angular position shown in FIG. 3*b*. Accordingly, the coil spring 13 is twisted in the reverse direction, and thereby the inside diameter is increased to disengage the coupling member 12 from the feed roller gear 10. Consequently, the feed roller 3 is allowed to rotate freely by the running sheet at a circumferential speed corresponding to the sheet conveying speed.

Upon the separation of the trailing edge of the sheet from the feed roller 3, the torque applied to the feed roller 3 by the running sheet disappears, and then the feed roller 3 remains stationary while the relative angular position thereof relative to the feed roller shaft 11 changes from the relative angular position shown in FIG. 3*b* to a relative angular position shown in FIG. 3*c*. After the relative angular position shown in FIG. 3*c* has been established, the feed roller 3 is interlocked again with the feed roller gear 10 and is driven at the sheet feeding speed by the feed roller gear 10. Thus, the feed of the second sheet is suspended temporarily while the first sheet is being conveyed by the conveyor roller 4, so that the first and second sheets are conveyed with an increased interval therebetween.

As is apparent from the foregoing description, the automatic sheet feeder of the present invention employs the foregoing simple mechanism for conveying sheets with an increased interval between the trailing edge of the preceding sheet and the leading edge of the succeeding sheet, which enables accurate detection of the leading and trailing edges of the sheets while the sheets are being conveyed. Thus, the automatic sheet feeder of the present invention is effectively applicable to information reading and transmitting equipment which reads and transmits information recorded on individual sheets, such as facsimile equipment.

While only a certain embodiment of the present invention has been described, it will be apparent to those skilled in the art that various changes and modifications may be made therein without departing from the spirit and scope of the present invention as claimed.

What is claimed is:

1. An automatic sheet feeder comprising:

a feed roller for feeding sheets one by one to a sheet conveying path;

a feed roller shaft for supporting the feed roller;

a conveyor roller provided downstream of said feed roller on the sheet conveying path, said conveyor roller conveys sheets fed by the feed roller to an image reading unit at a first speed;

a feed roller gear supported on said feed roller shaft for rotating said feed roller at a second speed, said first speed being greater than said second speed;

clutch means for connecting said feed roller gear to the feed roller shaft to rotate said feed roller at the second speed until a leading edge of a sheet being fed by said feed roller arrives at a nipping line of the conveyor roller whereafter said feed roller is uncoupled from the feed roller gear and is rotated at the first speed by movement of said sheet, said clutch means comprises a coupling member supported on said feed roller shaft and a spring extending between said coupling member and said feed roller gear; and means for temporarily stopping rotation of said feed roller after the sheet has passed from the feed roller whereby spacing between successive sheets fed past said conveyor roller can be maintained, said means for temporarily stopping comprises a notched portion at an end of said feed roller shaft, said notched portion being positioned in an opening defined in said coupling member, said coupling member at the opening having a generally flat face, said notched portion having two sides, a first side of said notched portion contacting said face when said feed roller is rotated at the first speed and a second side of said notch portion contacting the face when said feed roller is rotated at the second speed, said feed roller shaft and notched portion being rotatable relative to the coupling member whereby a time period is provided when said first side of the notched portion disengages from the face and said second side of the notched portion thereafter engages the face during which time period rotation of the feed roller is stopped to thereby maintain the spacing between successive sheets.

2. The automatic sheet feeder as recited in claim 1 wherein the spring is, a coil spring encircling the feed roller shaft and said coil spring is twisted to increase an inside diameter thereof to disengage the coupling member from the feed roller gear when the feed roller and conveyor roller are both conveying the sheet.

3. An automatic sheet feeder comprising:

a feed roller for feeding sheets one by one to a sheet conveying path;

a feeder roller shaft for supporting the feed roller;

a conveyor roller provided downstream of said feed roller on a sheet conveying path, said conveyor roller conveys sheets fed by the feed roller to an image reading unit at a first speed;

a feed roller gear supported on said feed roller shaft for rotating said feed roller at a second speed, said first speed being greater than said second speed;

clutch means for connecting said feed roller gear to the feed roller shaft to rotate said feed roller at the second speed until a leading edge of a sheet being fed by said feed roller arrives at a nipping line of the conveyor roller whereafter said feed roller is uncoupled from the feed roller gear and is rotated at the first speed by movement of said sheet, said clutch means comprises a coupling member supported on said feed roller shaft and a spring extending between said coupling member and said feed roller gear, said spring is a coil spring encircling the feed roller shaft and said coil spring is twisted to increase an inside diameter thereof to disengage the coupling member from the feed roller gear when the feed roller and conveyor roller are both conveying the sheet; and means for temporarily stopping rotation of said feed roller after the sheet has passed from the feed roller whereby spacing between successive sheets fed past said conveyor roller can be maintained.

4. An automatic sheet feeder comprising:

a feed roller for feeding sheets one by one to a sheet conveying path;

a feed roller shaft for supporting the feed roller;

a conveyor roller provided downstream of said feed roller on the sheet conveying path, said conveyor roller conveys sheets fed by the feed roller to an image reading unit at a first speed;

a feed roller gear supported on said feed roller shaft for rotating said feed roller at a second speed, said first speed being greater than said second speed;

clutch means for connecting said feed roller gear to the feed roller shaft to rotate said feed roller at the second speed until a leading edge of a sheet being fed by said feed roller arrives at a nipping line of the conveyor roller whereafter said feed roller is uncoupled from the feed roller gear and is rotated at the first speed by movement of said sheet; and means for temporarily stopping rotation of said feed roller after the sheet has passed from the feed roller whereby spacing between successive sheets fed past said conveyor roller can be maintained, said means for temporarily stopping comprises a notched portion at an end of said feed roller shaft, said notched portion being positioned in an opening defined in said coupling member, said coupling member at the opening having a generally flat face, said notched portion having two sides, a first side of said notched portion contacting said face when said feed roller is rotated at the first speed and a second side of said notch portion contacting the face when said feed roller is rotated at a second speed, said feed roller shaft and notched portion being rotatable relative to the coupling member whereby a time period is provided when said first side of the notched portion disengages from the face and said second side of the notched portion thereafter engages the face during which time period rotation of the feed roller is stopped to maintain the spacing between successive sheets.

5. The automatic sheet feeder as recited in claim 4 wherein said feed roller shaft and notched portion are rotatable relative to said coupling member for less than 360°.

* * * * *